United States Patent [19]

McCandless

[11] 4,170,970

[45] Oct. 16, 1979

[54] INTERNAL COMBUSTION ENGINES

[76] Inventor: John H. McCandless, 2724 San Rae Dr., Kettering, Ohio 45419

[21] Appl. No.: 740,537

[22] Filed: Nov. 10, 1976

[51] Int. Cl.[2] ..... F02B 33/22; F02B 25/12

[52] U.S. Cl. ..... 123/53 BA; 123/51 BA; 123/70 R; 123/78 F

[58] Field of Search ..... 123/51 BA, 52 A, , 53 R, 123/53 B, 53 BA, 78 F, 51 AA, 70 R

[56] References Cited

U.S. PATENT DOCUMENTS

| | | | |
|---|---|---|---|
| 2,097,742 | 11/1937 | Scott | 123/53 AA |
| 2,858,816 | 11/1958 | Prentice | 123/51 BA |
| 3,623,463 | 11/1971 | Vries | 123/70 R |
| 3,633,552 | 1/1972 | Huber | 123/78 F |
| 3,675,630 | 7/1972 | Stratton | 123/70 R |
| 3,934,562 | 1/1976 | Isaka | 123/53 BA |

FOREIGN PATENT DOCUMENTS

| | | | |
|---|---|---|---|
| 377061 | 6/1923 | Fed. Rep. of Germany | 123/53 BA |
| 614347 | 5/1935 | Fed. Rep. of Germany | 123/53 BA |
| 712160 | 9/1931 | France | 123/70 R |
| 324409 | 1/1930 | United Kingdom | 123/53 AA |

*Primary Examiner*—Charles J. Myhre
*Assistant Examiner*—Craig R. Feinberg

[57] ABSTRACT

A split four-cycle engine in which the cylinders are arranged in pairs. The intake and compression strokes take place in one cylinder. The power and exhaust strokes take place in the other cylinder. The cylinders are connected by a passageway which is controlled by valves. The valves permit gases which are compressed in one cylinder to be transferred to the second cylinder where they can be burned to produce power. The pistons in the two cylinders are connected to separate cranks. These cranks are connected by a set of differential gears in a manner which will cause any change in the angular position of the rotor of the gears to change the phase relation between the cranks. This will be converted into a change in the compression ratio of the engine in a manner which will be described in detail later. The engine will be coupled to the butterfly valve of a carburetor in a manner which will cause the compression ratio of the engine to change with any change in the pressure of the gases being drawn from the carburetor and completely compensate for such changes in pressure. For this reason, ignition will always occur when the gases are fully compressed. This should make the engine more efficient than a conventional engine and it should produce less pollution than a conventional engine.

2 Claims, 10 Drawing Figures

INTERNAL COMBUSTION ENGINES

BACKGROUND OF THE INVENTION

1. Field of the Invention

This invention relates to a split four-cycle engine system in which the intake and compression strokes and the power and exhaust strokes take place in separate cylinders. Means are provided for transferring compressed gases from one cylinder to another where they are burned. Means are also provided for causing the compression ratio to vary inversely with the pressure of the gases in the intake manifold so as to keep the pre-ignition pressure of the gases nearly constant.

2. Prior Art

Internal combustion engines which are now in use are not efficient at light loads and they produce large quantities of carbon monoxide and other pollutants at light loads. These engines must burn a closely controlled mixture of about 14 pounds of air to a pound of gasoline. It is not possible to reduce the amount of fuel being burned in an engine of this type without making a corresponding reduction in the amount of air being drawn into the engine. When these engines are operating at light loads, air and fuel mixtures are drawn into them under partial vacuums. Even after gases at these low pressures are compressed in an engine, the pre-ignition pressures are low. Engines will not operate efficiently at these low pressures because there is not enough air in their cylinders to expand and do work. Fuels will not burn completely at these low pressures because there is not enough oxygen in their cylinders to completely support combustion. An engine which will burn air and fuel mixtures at full compression at all loads should be more efficient and produce less pollution than a conventional engine.

In 1958, U.S. Pat. No. 2,858,816 was issued on a Diesal engine in which the compression ratio could be changed by changing the phase relation between two cranks. This engine was arranged with two pistons operating in the same cylinder. This arrangement would not produce enough turbulance to produce efficient combustion in any kind of an engine except a Diesal engine.

All modern internal combustion engines are arranged with special cylinder heads which create turbulance in the burning gases. The gases are squeezed between the pistons and surfaces on the cylinder heads in a manner which forces them out into combustion chambers at high speeds and causes them to create turbulance. Although these methods are in general use, they are not very satisfactory because they function at the end of the stroke when the pistons are moving at very low speeds. They barely work at all when the engines are idling or operating at very low speeds.

This invention solves these problems which the prior art has failed to solve. By first compressing gases in one cylinder and then transferring them to a second cylinder it is possible to produce a high degree of turbulance. By using a variable compression arrangement and coupling it to a carburetor in a manner which will cause gases to be burned at full compression at all loads, it should be possible to overcome the principle drawbacks to the conventional internal combustion engine.

SUMMARY OF THE INVENTION

The object of this invention is to provide a split four-cycle engine in which gases will be burned at full compression at all loads. The power output of the engine will be changed by changing the amount of fully compressed gases which will be burned to supply power instead of changing the pressure under which the gases are burned as is the case in the conventional internal combustion engine. This is accomplished by compressing gases in a cylinder, and transferring the gases to a second cylinder where they are burned. The pistons in the two cylinders are connected to separate crank shafts. The crank shafts are connected by a differential device which controls the phase relation between the cranks and which is controlled by an accelerator pedal. The phase difference between the cranks is converted into a difference in compression ratio. Changes in compression ratio compensate for changes in the pressure of the gases being drawn from the carburetor.

An object of this invention is to provide a four-cycle engine which will be more efficient than a conventional engine.

Another object of this invention is to provide a four-cycle engine which will be more flexible and which will require a simpler transmission transmission than a conventional engine.

Another object of this invention is to provide a four-cycle engine which will produce less pollution than a conventional engine.

Another object of this invention is to provide a four-cycle engine which will not require the expensive and troublesome pollution control devices which are needed by conventional engines.

DETAILED DESCRIPTION OF THE INVENTION

Figure 1:
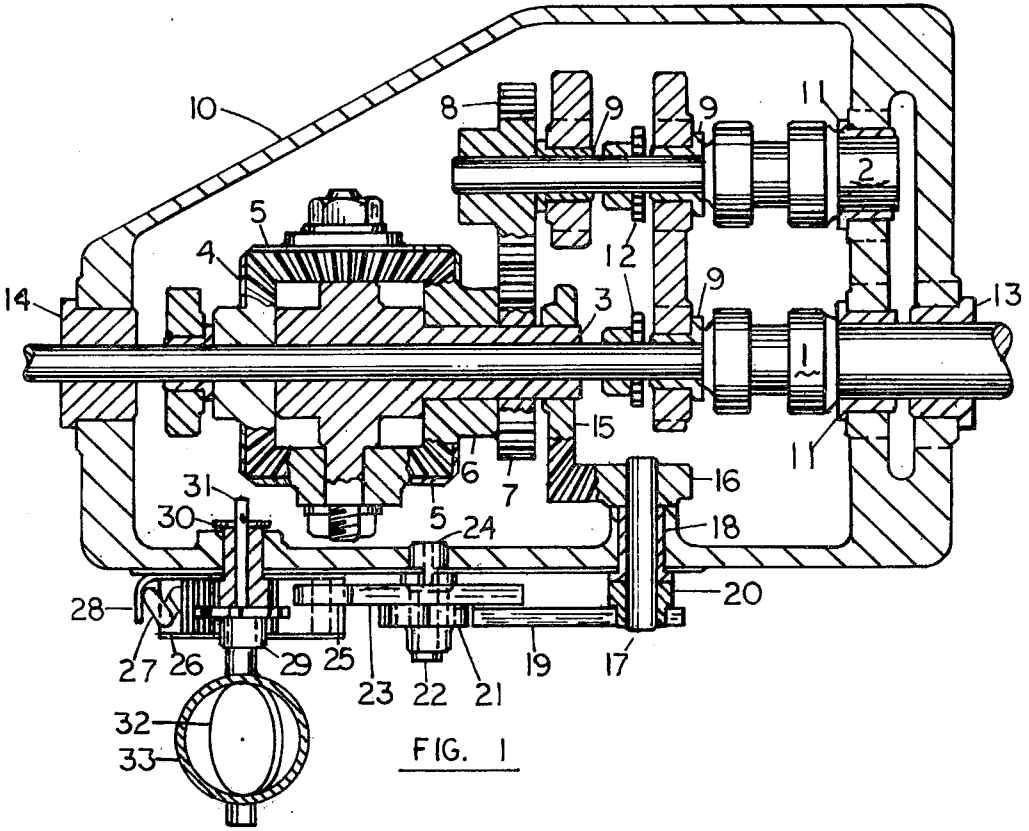
FIG. 1 shows an arrangement of differential gears which can be used to control the phase relation between two cranks. It also shows linkages which can be used to control the butterfly valve of a carburetor. Both the differential gear device and the carburetor linkages are controlled by the same accelerator pedal.

In FIG. 1, Parts 1 and 2 are crank shafts. Part 3 is the rotor of a set of differential gears. Parts 4, 5 and 6 are bevel gears. Part 4 is keyed to crank shaft Part 1 so that it will turn with this crank shaft. Parts 5 mesh with Part 4 as shown. Parts 5 turn on tenons which are parts of Part 3 (the rotor). Part 6 meshes with Parts 5. It turns on a hub which is part of Part 3 (the rotor). Parts 7 and 8 are spur gears which have equal pitch diameters. They mesh together as shown. Part 7 is riveted to Part 6 so that it will turn with Part 6. Part 7 turns on the hub portion of Part 3. Part 8 is keyed to crank shaft Part 2 so that it will turn with this crank shaft. Parts 9 are journal bearings or their equivalent. Part 10 is a crank case which is shown moulded to the engine block. Part 11 is a journal bearing. Parts 12 are sprocket wheels. Parts 13 and 14 are standard oil seals. Part 15 is a bevel gear segment which is keyed to Part 3 (the rotor). Part 16 is a bevel gear segment which meshes with Part 15. Part 16 is keyed to Part 17 which is a shaft. Part 18 is a journal bearing. Part 19 is an accelerator pedal which is riveted to Part 20 which is a hub. Part 20 is keyed to Part 17.

If Part 3 is held stationary so that it cannot turn and Part 1 is turned, Part 2 will turn in the same direction as Part 1 and at the same speed as Part 1. If the accelerator pedal (Part 19) is moved, this motion will be transmitted to Part 3 (the rotor) through the gear segments Parts 15 and 16, and Part 3 will turn. This will create a phase difference between Parts 1 and 2. Any angular displacement of Part 3 will create a change in the phase difference between Parts 1 and 2 which will be twice as great as this displacement. For example, if Part 3 is turned through an angle of 10 degrees, the phase relation between the cranks will change by 20 degrees. Parts 19 through 31 are linkages which are connected to Part 32 which is the butterfly valve of a carburetor which is Part 33. These linkages are shown more clearly in FIG. 2.

Figure 2:
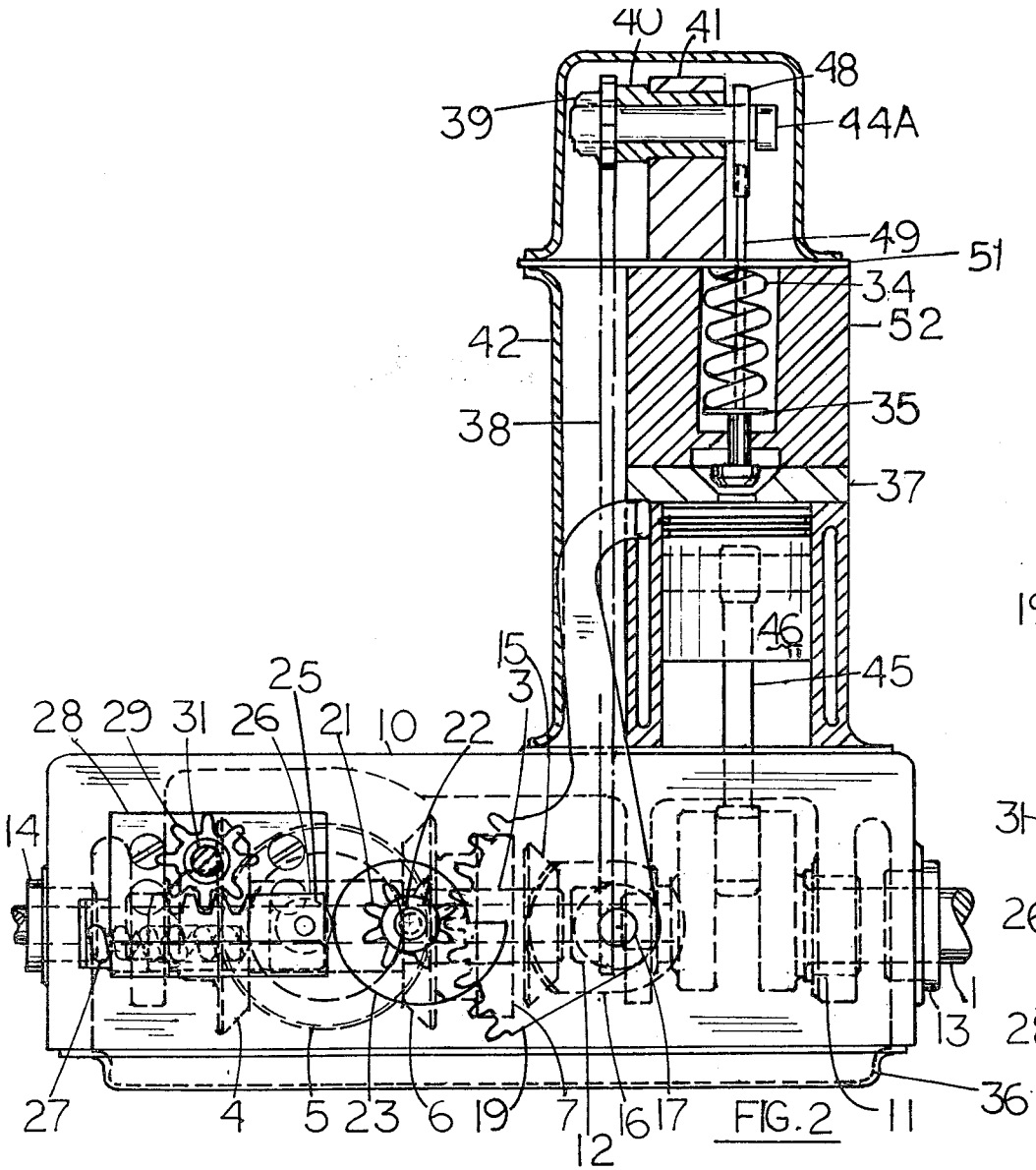
FIG. 2 shows a side view of this engine.

FIG. 2 shows a gear segment on Part 19 (the accelerator pedal). This gear segment meshes with Part 21 which is a gear. Part 21 turns on Part 22 which is a shaft and it is riveted to Part 23 which is a cam. Part 23 contacts Part 25 which is a roller. Part 25 is mounted on Part 26 which is a rack. Part 26 is shown more clearly in FIG. 9 on Sheet 5. Part 26 contains Part 27 which is a spring. Part 27 contacts Part 28 as shown. Part 28 is screwed and doweled to Part 10 (the crank case) and it is formed to provide a U shaped channel in which Part 26 can slide. A portion of Part 28 is formed to provide a stop for the spring (Part 27) as shown. Part 28 is shown more clearly in FIG. 8 on Sheet 5. Part 29 is a gear which meshes with the rack (Part 26). Part 29 is keyed to Part 31 which is a shaft. Part 31 is connected to Part 32 which is the butterfly valve of the carburetor (Part 33). It is obvious that any motion of Part 19 will cause Part 32 to turn in Part 33.

The position of the butterfly valve in a carburetor controls the pressure of the gases being drawn from the carburetor. When the valve is wide open, the pressure of the gases in the intake manifold will be nearly atmospheric or around 14 pounds to the square inch. When the valve is closed, the intake pressure may be as low as three pounds to the square inch. When the valve is partly open, the pressure will be between these figures.

Parts 34 are valve springs. Parts 35 are washers. Part 36 is an oil pan. Part 37 is a valve plate. Parts 38 can be either chain drives or serrated neoprene belts. Parts 39 are sprockets. Parts 40 are journal bearings or their equivalent. Part 41 is a mounting block. Part 42 is a housing.

Figure 3:
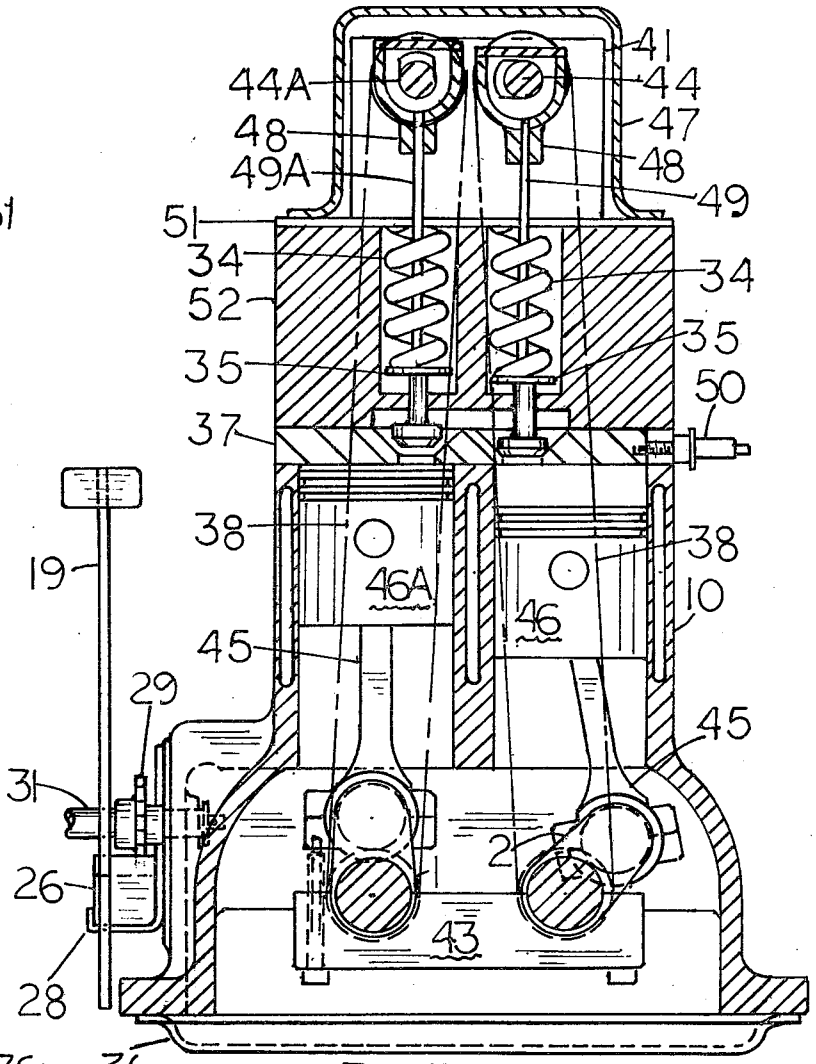
FIG. 3 shows a vertical cross section of the engine.

In FIG. 3, Part 43 is the lower half of a main bearing. It is screwed to a bearing support which is shown moulded to Part 10 (the crank case and engine block). All of the main bearings are arranged in two parts as shown here. The oil seals are also arranged like this. This is standard procedure in all engines.

The cylinder which is located on the left side of the drawing is a compression cylinder in which gases are compressed. The cylinder which is on the right is a power cylinder in which gases are burned. The cranks are shown with 45 degrees of phase difference between them. The cranks are assumed to be turning in a clockwise direction so that the crank in the power cylinder is 45 degrees ahead of the crank in the compression cylinder.

FIG. 3 shows the phase difference between the cranks at 45 degrees. When the engine is running with this much phase difference between the cranks, the space above the compression piston will be rather large at the moment when the power piston reaches the top of its stroke. Therefore the compression ratio will be low. When the phase difference between the cranks is less than 45 degrees, the space into which gases are compressed above the compression piston will be smaller and the compression ratio will be increased. Any change in the phase difference between the cranks will produce a change in the compression ratio of the engine. Since Part 19 (the accelerator pedal) is linked to Part 3 which is the rotor of the set of differential gears, any motion of Part 19 will cause a change in the compression ratio of the engine. This motion will also cause the butterfly valve (Part 32) to turn. By properly shaping the cam (Part 23), it should be possible to have changes in intake pressure be compensated for by changes in compression ratio. For example, suppose that the butterfly valve (Part 32) is at an angle which will cause the carburetor to produce gases with a pressure of 14 pounds to the square inch when the rotor (Part 3) will be at an angle which would produce a 9 to 1 compression ratio. Gases would then be compressed to 9 times 14=126 pounds to the square inch. However, if the butterfly valve (Part 32) is at an angle which will cause the carburetor to produce gases at a pressure of 7 pounds to the square inch, the rotor (Part 3) will be turned at an angle which will produce an 18 to 1 compression ratio. The gases would be compressed to a pressure of 7 times 18=126 pounds to the square inch as before. In this way the engine could be made to burn fully compressed gases at all loads. The engine should therefore operate much more efficiently than a conventional engine and it should produce much less pollution than a conventional engine.

Parts 44 and 44A are cam shafts. Parts 45 are connecting rods. Parts 46 and 46A are pistons. Part 47 is a cam shaft housing. Parts 48 are valve lifters. Parts 49 and 49A are valves which are arranged to resist pressure from above. Part 37 is needed because of this valve arrangement. Part 37 has valve seats on its upper surface. Part 50 is a spark plug. Part 51 is a spring retainer plate. Part 552 is a cylinder head.

Cam Part 44 is timed to cause valve Part 49 to close when piston Part 46 nears the bottom of its stroke and to open when this piston nears the top of its stroke. Cam 44A is timed to cause valve 49A to open when piston 46A nears the bottom of its stroke and to close when this piston nears the top of its stroke. Therefore valves 49 and 49A will be open from the time when piston 46 reaches the top of its stroke until piston 46A reaches the top of its stroke but one valve or the other will be closed at all other times.

Gases which burn in the space above piston 46 in the power cylinder and in the passage between the cylinders will force piston 46 to move down in the power cylinder. This will cause piston 46A to move downward in the compression cylinder. An intake valve which will be described in detail later, will open when piston 46A is at the top of its stroke and close when this piston nears the bottom of its stroke. This will permit a fuel and air mixture to be drawn into the compression cylinder as piston 46A moves down in the cylinder. When piston 46 reaches the bottom of its stroke, an exhaust valve which will be described in detail later, will open and valve 49 will close. Therefore, as piston 46 moves upward in the power cylinder, exhaust gases will be forced out of the power cylinder. When piston 46A reaches the bottom of its stroke, the intake valve will close and valve 49A will open. As piston 46A moves upward in the compression cylinder, gases will be compressed in the upper part of the compression cylinder and into the passage between the cylinders. After piston 46 reaches the top of its stroke, the exhaust valve will close and valve 49 will open. As piston 46A continues to travel upward in the compression cylinder and piston 46 begins to descend in the power cylinder, compressed gases will flow from the compression cylinder to the power cylinder. While this is taking place, the spark plug will fire. Flaming gases spurting from the compression cylinder into the power cylinder will create the turbulance which is needed for efficient combustion. After piston 46A reaches the top of its stroke, valve 49A will close and the intake valve will open. The cycle will then repeat itself.

Figure 4:
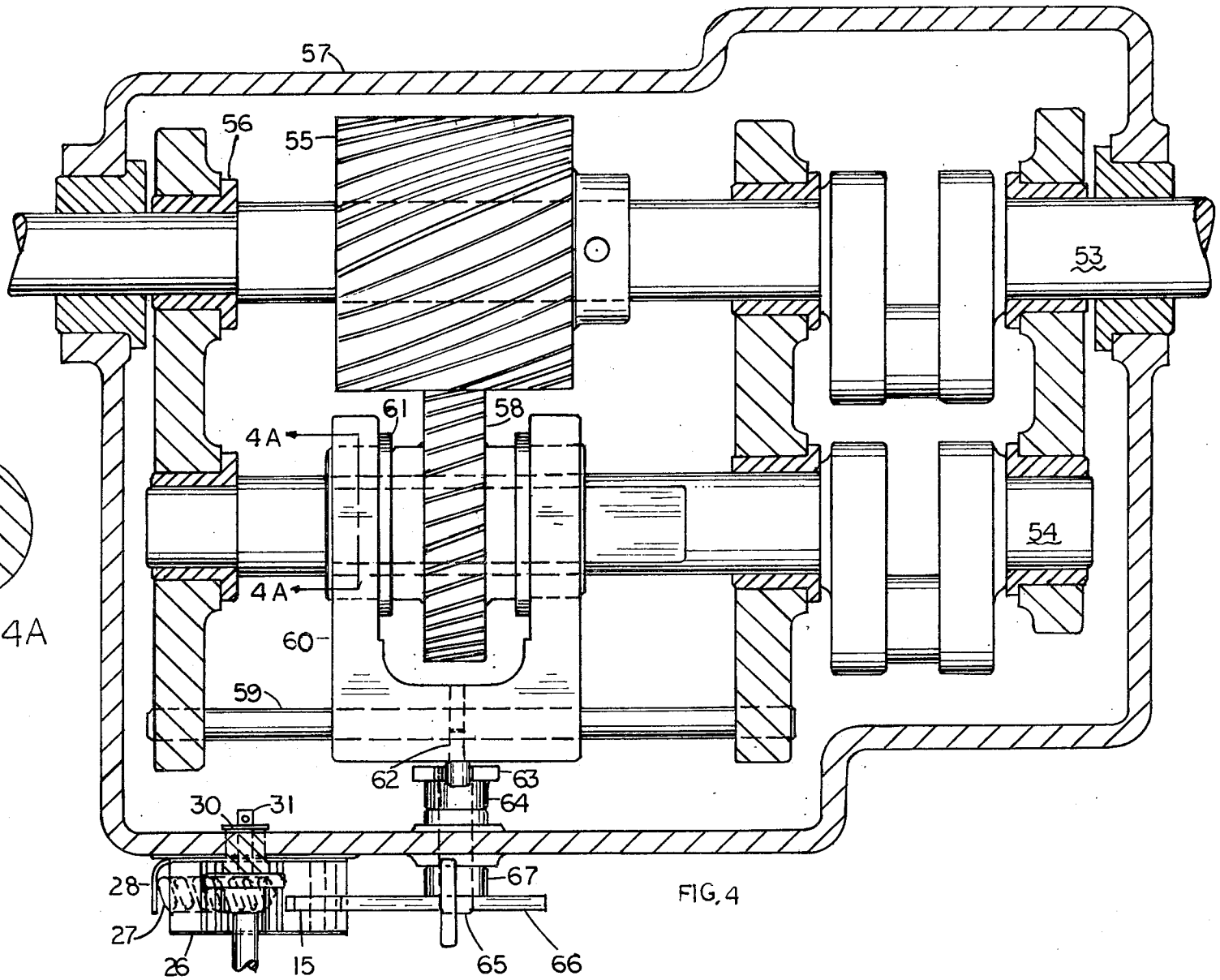
FIG. 4 shows an arrangement of helical gears which can be substituted for differential gears in this engine. It also shows linkages which can be used to control the butterfly valve of a carburetor. Both the helical gear arrangement and the carburetor linkages are controlled by the same accelerator pedal.
Figure 4A:
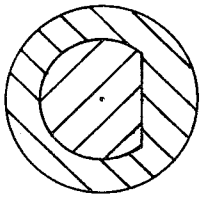

FIG. 4 shows an arrangement of helical gears which can be used in place of differential gears. Parts 53 and 54 are crank shafts. Part 55 is a helical gear which is keyed to Part 53 so that it will turn with Part 53. Parts 56 are journal bearings. Part 57 is a crank case. Part 58 is a helical gear which is arranged to slide along Part 54 and to turn with Part 54. It is fitted to a flat surface on Part 54 as shown in FIG. 4A—4A. It meshes with helical gear Part 55. Part 59 is a rod. Part 60 is a yoke which slides along Part 59. Part 60 is shown more clearly in FIG. 10 on Sheet 5. Parts 61 are bearings which are fitted to Part 54. Part 62 is a stud which is pressed into Part 60. Part 63 is an arm. A slot in the end of Part 63 engages Part 62. Part 64 is a hub which is riveted to Part 63. Part 64 is keyed to Part 65 which is a shaft. Part 66 is an accelerator pedal. Part 67 is a hub which is riveted to Part 66. It is obvious that any motion of Part 66 (the accelerator pedal) will cause Part 60 to move to the right or left. Since this will cause Part 58 to change its position with respect to Part 55, it will produce a change in the phase relation between crank shaft 53 and crank shaft 54.

Figure 5:
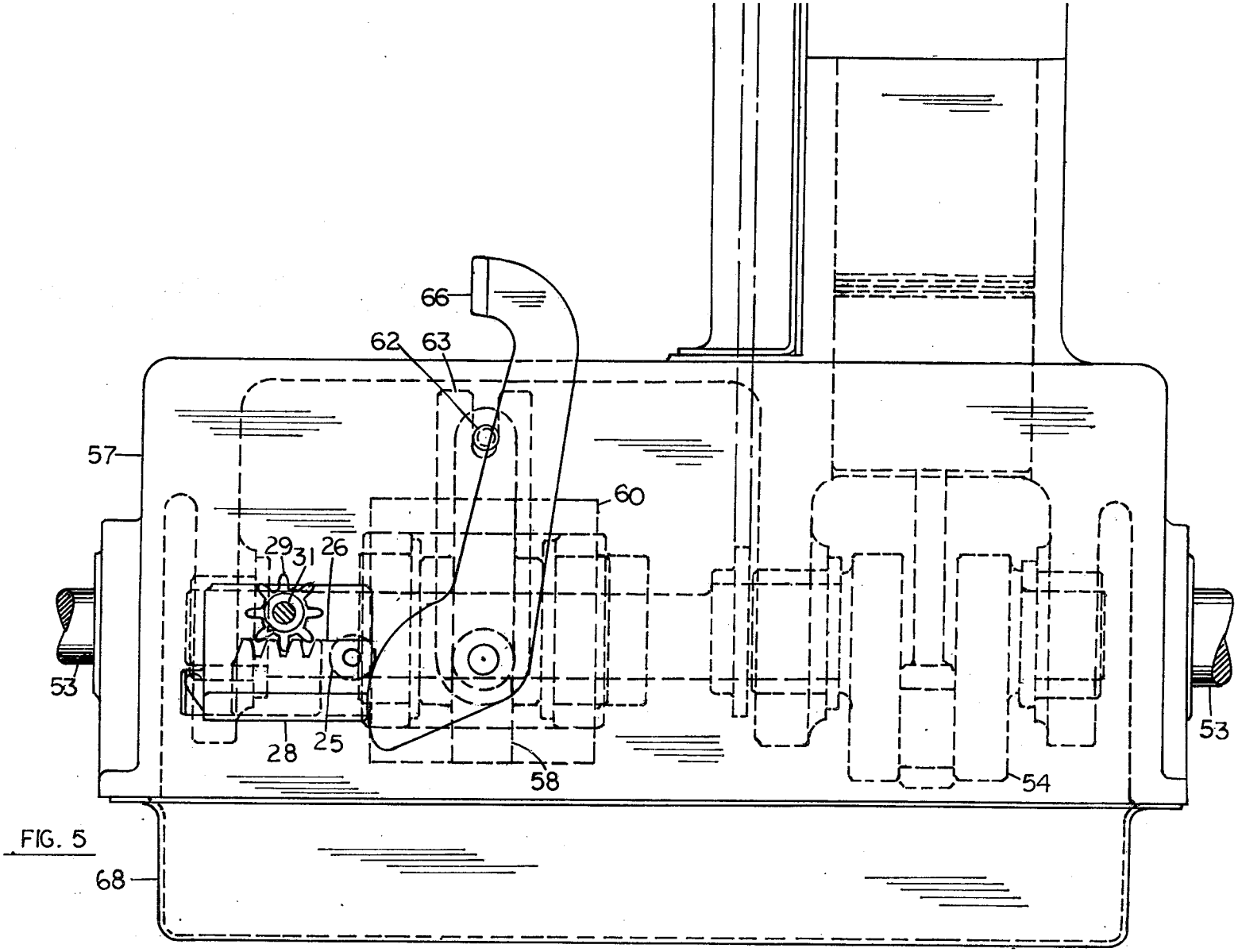
FIG. 5 shows a side view of an engine in which helical gears are used.

FIG. 5 shows linkages between the accelerator pedal (Part 66) and Part 31. A cam surface on Part 66 engages the roller (Part 25). Part 25 is mounted in the rack (Part 26). Part 26 meshes with the gear (Part 29). Part 29 is keyed to the shaft (Part 31). Part 31 is connected to the butterfly valve of a carburetor in the manner which was illustrated in FIG. 1. Part 68 is an oil pan.

The cam surface on Part 66 can be shaped in a manner which will cause any change in the pressure of the gases being drawn from the carburetor to be compensated for by a change in the compression ratio of the engine just as was the case with the differential gear arrangement.

Figure 6:
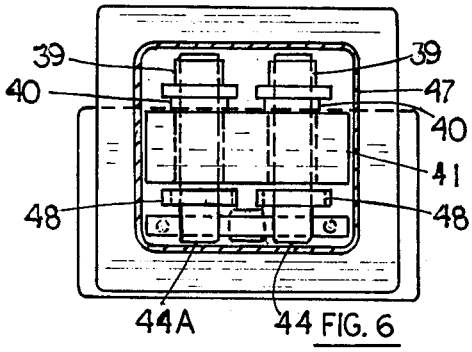
FIG. 6 shows a top view of the engine with an arrangement for controlling intake valves and exhaust valves.
Figure 7:
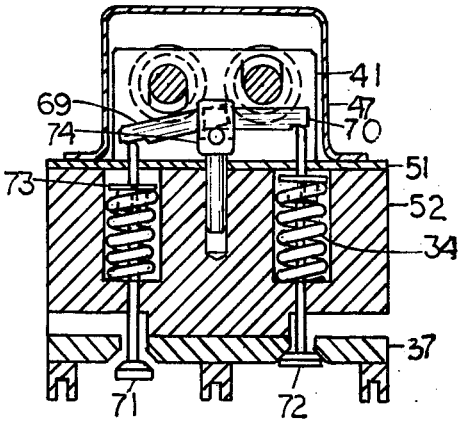
FIG. 7 shows a vertical cross section of the arrangement for controlling intake valves and exhaust valves.

FIG. 6 on Sheet 5 shows the top view of the cam shaft assembly. FIG. 7 shows the front view of this assembly and the arrangement for operating the intake valve and the exhaust valve. Parts 69 and 70 are rocker arms. Part 71 is an intake valve. Part 72 is an exhaust valve. Parts 73 are standard split collet spring retainers. Part 74 is a standard hydraulic lash adjuster such as is used on most engines which have overhead cam shafts.

Figure 8:
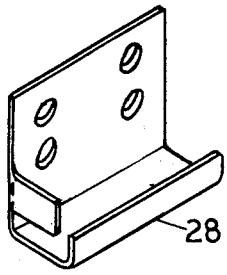
FIG. 8 shows an isometric view of part 28.
Figure 9:
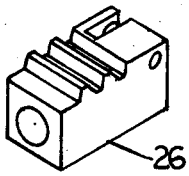
FIG. 9 shows an isometric view of part 26.
Figure 10:
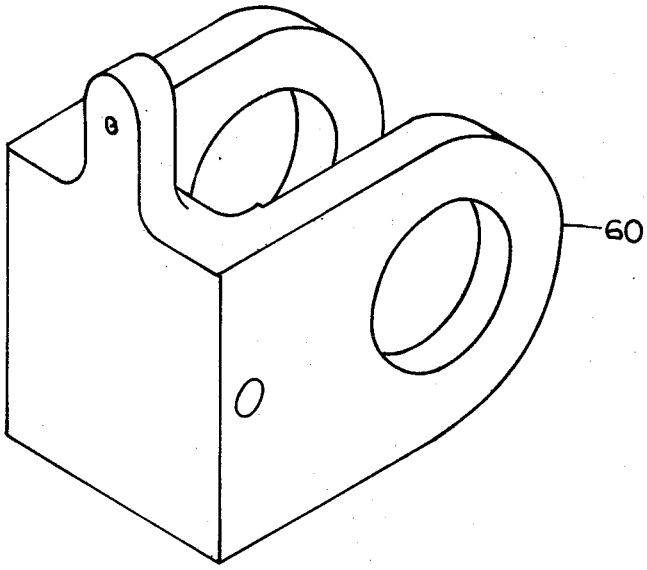
FIG. 10 shows an isometric view of part 60.

FIGS. 8, 9, and 10 are isometric views of Parts 28, 26, and 60 as mentioned earlier in this paper.

I claim:

1. A split four cycle variable compression combustion engine comprising:

cylinders which are arranged in pairs so that intake and compression strokes take place in one cylinder and power and exhaust strokes take place in a second cylinder with the pistons of the two cylinders connected to separate cranks;

a system of differential gears which are controlled by an accelerator pedal and which connect the two cranks in a manner which will cause any motion of the accelerator pedal to change the phase relation between the cranks;

a means of causing changes in the phase relation between the cranks to produce changes in the compression ratio of the engine;

a passageway which connects the tops of the two cylinders and which is controlled by two valves which will permit gases to flow between the cylinders from the time when one piston nears the top of its stroke until the other piston nears the top of its stroke but which will prevent gases from flowing between the cylinders at all other times;

linkages which include a cam and which connect to a rotor coming from the differential gears to the throttle valve of a carburetor in a manner which will cause any change in the pressure of the gases in an intake manifold to be compensated for by changes in the compression ratio of the engine thus keeping the pressures at the time of ignition constant at all loads.

2. A split four cycle variable compression internal combustion engine comprising:

cylinders which are arranged in pairs so that intake and compression strokes take place in one cylinder and power and exhaust strokes take place in a second cylinder with the pistons of the two cylinders connected to separate cranks;

a pair of helical gears which are mounted on the separate cranks and which are connected by linkages to an accelerator pedal so that any motion of the accelerator pedal will cause the gears to move axially with respect to each other and thus produce a change in the phase relation between the cranks;

a means of causing any change in the phase relation between the cranks to produce a change in the compression ratio of the engine;

a passageway which connects the tops of the two cylinders and which is controlled by two valves which permit gases to flow between the two cylinders from the time when one piston reaches the top of its stroke until the other piston nears the top of its stroke but which prevent gases from flowing between the cylinders at all other times;

and linkages which include a cam and which connect the accelerator pedal to the butterfly valve of a carburetor in a manner which will cause any changes in the pressure of gases in an intake manifold to be compensated for by changes in the compression ratio of the engine thus keeping the pressures at the time of ignition constant at all loads.

* * * * *